US011859919B2

(12) United States Patent
Kent

(10) Patent No.: US 11,859,919 B2
(45) Date of Patent: Jan. 2, 2024

(54) TUBE BODY FOR A HEAT EXCHANGER AND HEAT EXCHANGER

(71) Applicant: MAHLE International GmbH, Stuttgart (DE)

(72) Inventor: Scott Edward Kent, Albion, NY (US)

(73) Assignee: Mahle International GmbH, Stuttgart (DE)

( * ) Notice: Subject to any disclaimer, the term of this patent is extended or adjusted under 35 U.S.C. 154(b) by 40 days.

(21) Appl. No.: 17/095,250

(22) Filed: Nov. 11, 2020

(65) Prior Publication Data

US 2021/0140720 A1 May 13, 2021

(30) Foreign Application Priority Data

Nov. 11, 2019 (DE) ..... 10 2019 217 368.3

(51) Int. Cl.
*F28F 1/02* (2006.01)

(52) U.S. Cl.
CPC ..... *F28F 1/022* (2013.01); *F28F 2255/16* (2013.01)

(58) Field of Classification Search
CPC ... F28F 1/022; F28F 2255/16; F28D 1/05383; F28D 2021/0035; F28D 2021/008
USPC ..... 165/153
See application file for complete search history.

(56) References Cited

U.S. PATENT DOCUMENTS

| | | | | |
|---|---|---|---|---|
| 5,058,266 | A | 10/1991 | Knoll | |
| 5,251,692 | A * | 10/1993 | Haussmann | F28F 1/022 165/177 |
| 10,451,360 | B2 * | 10/2019 | Zager | F28F 1/022 |
| 11,353,271 | B2 * | 6/2022 | Jiang | F28F 1/128 |
| 2002/0184765 | A1 * | 12/2002 | Rhodes | F28F 9/182 29/890.053 |
| 2010/0050685 | A1 * | 3/2010 | Yanik | F28F 1/022 62/515 |
| 2010/0089546 | A1 * | 4/2010 | Perez | F28D 1/05383 165/41 |
| 2011/0203777 | A1 * | 8/2011 | Zhao | F28D 15/0283 29/890.032 |
| 2012/0181007 | A1 * | 7/2012 | Liu | F28F 1/022 165/177 |

(Continued)

FOREIGN PATENT DOCUMENTS

| | | |
|---|---|---|
| DE | 3730117 C1 | 6/1988 |
| DE | 19645089 A1 | 8/1998 |

(Continued)

*Primary Examiner* — Jon T. Schermerhorn, Jr.
(74) *Attorney, Agent, or Firm* — Ewers IP Law PLLC; Falk Ewers

(57) ABSTRACT

A tube body for a heat exchanger includes an outer cover and intermediate walls arranged in the outer cover, which within the outer cover limit passages that are separated from one another in a width direction and can be flowed through in a longitudinal direction. An increased stability of the tube body with reduced weight at the same time is obtained in that a wall thickness running in the width direction of at least one inner intermediate wall, which is arranged between in the width direction outer intermediate walls, that is greater than the wall thickness of the respective outer intermediate wall. In addition, a heat exchanger having such a tube body, a motor vehicle and a building having such a heat exchanger are provided.

14 Claims, 1 Drawing Sheet

(56) References Cited

U.S. PATENT DOCUMENTS

| | | | | |
|---|---|---|---|---|
| 2015/0192372 | A1* | 7/2015 | Mun | F28F 1/128 165/174 |
| 2016/0211558 | A1* | 7/2016 | Ma | H01M 10/63 |
| 2018/0164052 | A1* | 6/2018 | Nakamura | C23F 13/08 |
| 2018/0313610 | A1* | 11/2018 | Fukada | F28D 1/05366 |
| 2018/0372429 | A1* | 12/2018 | Maeda | F28F 1/32 |

FOREIGN PATENT DOCUMENTS

| | | | |
|---|---|---|---|
| DE | 19921407 | A1 | 11/2000 |
| DE | 102008007587 | A1 | 8/2009 |
| EP | 881448 | B1 | 3/2004 |

* cited by examiner

TUBE BODY FOR A HEAT EXCHANGER AND HEAT EXCHANGER

CROSS REFERENCE TO RELATED APPLICATIONS

This application claims priority to German patent application DE 10 2019 217 368.3, filed Nov. 11, 2019, the entire content of which is incorporated herein by reference.

TECHNICAL FIELD

The present disclosure relates to a tube body for a heat exchanger having an outer cover which in which multiple intermediate walls are arranged in order to separate passages which can be flowed through. The disclosure, furthermore, relates to a heat exchanger having at least one such tube body. The disclosure, furthermore, relates to a motor vehicle and to a building having such a heat exchanger.

BACKGROUND

The use of tube bodies with a micro-channel structure is thoroughly known from the related art. Such tube bodies comprise an outer cover which extends in a longitudinal direction and limits an inner volume in a circumferential direction, wherein in the inner volume multiple intermediate walls are arranged, which are spaced apart from one another in a width direction running transversely to the longitudinal direction, in order to form within the outer cover multiple passages that are separated from one another in the width direction and can be flowed through in the longitudinal direction. In an associated heat exchanger, the tube body is usually connected in a chamber of the heat exchanger in order to introduce a fluid into the tube body or discharge a fluid from the tube body. The connection of such chambers to the tube body is usually effected in a firmly bonded manner.

For the increased stability of such a tube body EP 0 881 448 B1 proposes to form the two, in width direction, outermost passages with a round cross section.

DE 37 30 117 C1 describes a tube body having two intermediate walls for increased mechanical stability of the tube body during the soldering of the tube body, wherein the two intermediate walls for this purpose follow a curved course.

From DE 10 2008 007 587 A1, a tube body produced from a sheet metal strip by forming is known, wherein ends of the sheet metal strip for forming two passages, engaging into one another are positively connected to one another and are additionally attached to one another in a firmly bonded manner.

For increased efficiency of an associated heat exchanger, DE 196 45 089 A1 proposes a shape of the tube body that is oval in the cross section, wherein the tube body on the outside is provided with a fabric material in order to absorb condensate generated.

For the cost-effective production of such a tube body it is proposed in DE 199 21 407 A1 to introduce mouldings on the tube body outside and to fill these with solder material in order to simplify a subsequent soldering of the tube body in an associated heat exchanger.

Disadvantageous with the tube bodies and heat exchangers known from the related art is in particular their lifespan and/or the increased weight.

SUMMARY

It is therefore an object of the present disclosure to provide a tube body of the type mentioned at the outset and for a heat exchanger having such a tube body, a motor vehicle, and a building having such a heat exchanger, improved or at least other embodiments which are characterized in particular by an increased lifespan and/or stability with reduced weight at the same time.

According to an aspect of the disclosure, this object is achieved by a tube body for a heat exchanger, in particular in a motor vehicle or in a building, a heat exchanger, a motor vehicle, and a building as described herein.

The present disclosure is based on the general idea of mechanically stabilising a tube body with at least three intermediate walls by a reinforced wall thickness of at least one of the inner intermediate walls. Here, the surprising knowledge that during the lifespan of such tube bodies cracks predominantly occur in a central region of the tube body is utilised. With the greater wall thickness of the at least one inner intermediate wall, the development of such cracks is counteracted here so that the lifespan of the tube body and consequently of the associated heat exchanger is increased. At the same time, no completely solid formation of the tube body is required, so that the same can be produced in a weight-reduced manner which leads to a corresponding weight reduction of the associated heat exchanger.

According to an aspect of the disclosure, the tube body comprises an outer cover which extends in a longitudinal direction and in a circumferential direction limits an inner volume which in longitudinal direction can be flowed through by a fluid and is flowed through by the fluid during the operation. In the outer cover, at least three intermediate walls are arranged, namely two outer intermediate walls and at least one inner intermediate wall arranged between the outer intermediate walls. The intermediate walls are spaced apart relative to one another in a width direction running transversely to the longitudinal direction and separate passages running in the longitudinal direction and which can be flowed through in the longitudinal direction from one another in the width direction within the outer cover. The two outer intermediate walls are arranged located opposite in the width direction and each form the outermost intermediate walls and are thus nearest-adjacent to the outer cover in the width direction. The at least one intermediate wall is arranged between the outer intermediate walls and spaced apart relative to these in the width direction. According to the disclosure, at least one of the at least one intermediate walls has a wall thickness running in the width direction that is greater than the wall thickness of the respective outer intermediate wall running in the width direction.

Within the outer cover, the intermediate walls limit passages that are separated from one another and extend in the longitudinal direction. Typically, the outer intermediate walls each form such a passage with the outer cover while the inner intermediate walls limit such a passage with one another and the outer cover and/or one of the outer intermediate walls.

In principle, the tube body can merely have one such inner intermediate wall, wherein the wall thickness of the inner intermediate wall is greater than the wall thickness of the respective outer intermediate wall.

Preferred are embodiments in which the tube body comprises at least two, particularly typically at least three, in particular at least ten, for example seventeen, intermediate walls. Thus, the respective intermediate wall contributes to the increased mechanical stabilisation of the tube body and/or the efficiency of the associated heat exchanger is increased.

Embodiments, in which the tube body has an uneven number of inner intermediate walls have proved to be advantageous. Thus, an inner intermediate wall, which is a middle intermediate wall of the tube body, exists with the outer intermediate walls. This middle intermediate wall has preferentially a greater wall thickness than the outer intermediate walls.

In principle, the intermediate walls can each have different intervals in the width direction relative to one another. Advantageous are embodiments, in which the intermediate walls are arranged equidistantly in the width direction. Thus, a simplified production of the tube body is possible and/or the tube body has advantageous through-flow characteristics.

When the intermediate walls are spaced apart equidistantly relative to one another and when the tube body has an uneven number of inner intermediate walls, the aforementioned middle intermediate wall is arranged centrally regarding the tube body in the width direction. Here it is particularly preferred when this intermediate wall has a wall thickness that is greater than the wall thickness of the outer intermediate walls.

Advantageous embodiments provide that the tube body is formed symmetrically. With regard to a plane extending in the longitudinal direction and a height direction running transversely to the longitudinal direction and transversely to the width direction, particularly typically running in width direction in the middle through the tube body, the tube body is preferentially formed symmetrical. By way of this, the mechanical stability of the tube body is also increased and/or the production of the tube body simplified.

In principle, the at least one inner intermediate wall with the greater wall thickness can also have such a wall thickness which is greater than the corresponding wall thickness of the outer cover, in the following also referred to as cover wall thickness.

It is conceivable to select the wall thickness of the at least one inner intermediate wall with the greater wall thickness in any thickness.

Preferred are embodiments, in which the wall thickness of at least one of the at least one inner intermediate walls is maximally a third greater than the wall thickness of the respective outer intermediate wall. This leads to an increased mechanical stability of the tube body and prevents an excessive weight increase of the tube body through the greater wall thickness.

In principle, the tube body can have any shape.

Preferred are embodiments, in which the tube body is formed as a flat tube, wherein the flat tube has a width running in the width direction that is greater than a height of the tube body running in the height direction. In particular, the width is at least twice the size of the height, typically at least four times, particularly typically at least ten times greater than the height.

The respective intermediate wall typically follows an even course. It is preferred, in particular, when the wall thickness of the respective intermediate wall is substantially constant in the height direction.

Advantageous are embodiments, in which the outer cover, in the cross section, i.e. in the plane defined by the width direction and the height direction, has an oval shape, wherein the outer surfaces located opposite in the height direction run flat and parallel and the outsides located opposite in width direction follow a curved course.

It is preferred, furthermore, when at least one of the passages formed by the intermediate walls and the outer cover has a cross section which in the width direction is curved on the outside. This is preferentially achieved with a curved shape of the outside. Thus, the mechanical stability of the tube body is increased also in the region of the outsides of the tube body and the overall cross section of the flat tube that can be flowed through is increased.

In principle, the respective passage limited by the respective inner intermediate wall can have any shape.

Preferred are embodiments, in which the respective passage limited by the at least one intermediate wall has a cross section with a square basic shape, wherein it is advantageous when the corners of the basic shape are curved. This leads to an increased stability of the tube body.

Embodiments, in which the corners facing the intermediate wall with an enlarged wall thickness of at least one of the passages have a greater curvature radius than the corners that are distant from this intermediate wall prove to be advantageous. Thus, a further reinforcement is achieved in the region of the intermediate wall with the reinforced wall thickness so that the tube body in this region has a further increased mechanical stability.

When the tube body comprises at least two or more inner intermediate walls, it is conceivable in principle to provide merely one of the inner intermediate walls with the enlarged wall thickness, wherein this intermediate wall is advantageously the inner intermediate wall arranged in the middle in the width direction.

Also conceivable are embodiments in which multiple of the inner intermediate walls have an enlarged wall thickness. It is preferred when these are those inner intermediate walls which in the width direction of the tube body are arranged offset towards the middle of the tube body, particularly typically arranged in the width direction in the middle of the tube body. This is achieved for example by a three-division of the tube body so that the tube body in the width direction has two outer portions, wherein the respective outer portion comprises one of the outer intermediate walls and in the width direction extends from the associated intermediate wall as far as to the outside of the outer cover that is next-adjacent in the width direction. In addition, the tube body comprises an inner portion extending in the width direction and arranged between the outer portions, wherein in the inner portion the inner intermediate walls each have a wall thickness that is greater than the respective wall thickness of the outer intermediate walls.

Here it is preferred when merely a part of the inner intermediate walls has an enlarged wall thickness. In particular, the inner portion extends between a tenth and a third of the width of the outer cover. It is particularly preferred, furthermore, when the inner portion is arranged in the width direction centrally between the outer portions.

In an advantageous further development of the solution according to the disclosure, at least one of the outsides of the outer cover has a wall thickness running in the width direction which is greater than the wall thickness of the respective outer intermediate wall. Thus, the tube body is not only reinforced centrally in the width direction but also at the end side.

In principle, the tube body can be produced in any way.

The tube body is extruded for example from a metal or a metal alloy, in particular aluminium.

Alternatively, it is conceivable to produce the tube body from a flat material, in particular from a flat strip material, for example from sheet metal, by way of a forming method.

The enlarged wall thickness of the at least one inner intermediate wall can, in principle, be provided along the entire length of the inner intermediate wall.

It is also conceivable that the enlarged wall thickness is provided merely in a longitudinal end section of the tube body on the end side in the longitudinal direction, or in end-side longitudinal end portions of the tube body located opposite one another. Here, the knowledge is utilised that the thermal loads on the tube body occur in particular in the connecting region of the tube body to an associated chamber of the associated heat exchanger. Here, the connecting region is realised by receiving the tube body in this chamber, which is effected on the longitudinal end side of the tube body. By way of the enlarged wall thickness of the at least one inner intermediate wall in the associated longitudinal end portion, the extra requirement of material is thus realised merely in the respective region required so that the tube body has a required increased mechanical stability and at the same time a reduced weight and/or can be produced more cost-effectively.

It is to be understood that the besides the tube body an associated heat exchanger also belongs to the scope of this disclosure.

Here, the heat exchanger comprises at least one such tube body and at least one such chamber, in which the tube body with the longitudinal end portion is received. It is conceivable, in particular, to provide the heat exchanger with two such chambers located opposite in the longitudinal direction, wherein the respective longitudinal end portion of the tube body is received in one of the chambers.

Practically, the tube body is connected to the respective chamber, preferentially in a firmly bonded manner, in particular by a soldered connection.

With the respective chamber, introducing a fluid flowing through the tube body during the operation into the tube body and/or the discharging of the fluid from the tube body takes place. Thus, the respective chamber is in particular a distributor, for example a distributor tube, and/or a collector, in particular a collection tube.

The fluid flowing through the tube body is for example a temperature control medium, in particular a coolant.

The heat exchanger is fluidically separated from the temperature control medium, flowed through by a second fluid, wherein during the operation a heat exchange between the temperature control medium and this fluid occurs.

The heat exchanger is practically part of a circuit into which the heat exchanger is incorporated and through which the temperature control medium circulates during the operation.

The heat exchanger can be a condenser or an evaporator of the temperature control medium.

The heat exchanger is employed in particular in an air conditioning system in which the temperature control medium circulates as coolant or refrigerant.

The use of the heat exchanger both in a motor vehicle and also in buildings is conceivable.

When using the heat exchanger in a building, in particular an air conditioning system of a building, the increased mechanical stability of the tube body proves to be particularly effective because the temperature control medium in buildings usually circulates with increased pressures in the circuit compared with mobile applications.

It is to be understood that both a motor vehicle having such a heat exchanger and also a building having such a heat exchanger can each be likewise included in the scope of this disclosure.

Further important features and advantages of the disclosure are obtained from the drawings and from the associated figure description by way of the drawings.

It is to be understood that the features mentioned above and still to be explained in the following cannot only be used in the respective combination stated but also in other combinations or by themselves without leaving the scope of the present disclosure.

BRIEF DESCRIPTION OF THE DRAWINGS

The disclosure will now be described with reference to the drawings wherein.

DESCRIPTION OF EXEMPLARY EMBODIMENTS

Figure 2:
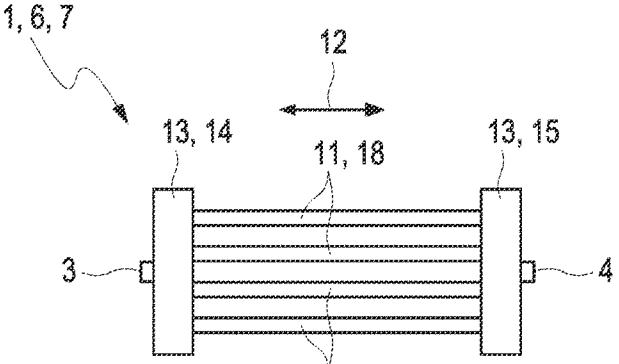
FIG. 2 shows a greatly simplified lateral view of the heat exchanger with tube bodies.

Exemplary embodiments of the disclosure shown in the drawings are explained in more detail in the following description, wherein same reference numbers relate to same or similar or functionally same components.

Figure 1:
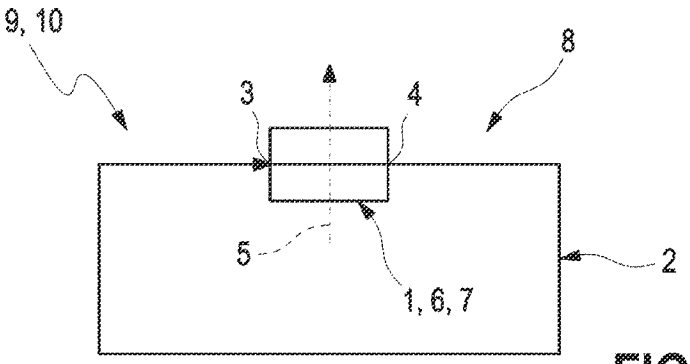
FIG. 1 shows a greatly simplified representation of a circuit in the manner of a circuit diagram with a heat exchanger.
Figure 3:
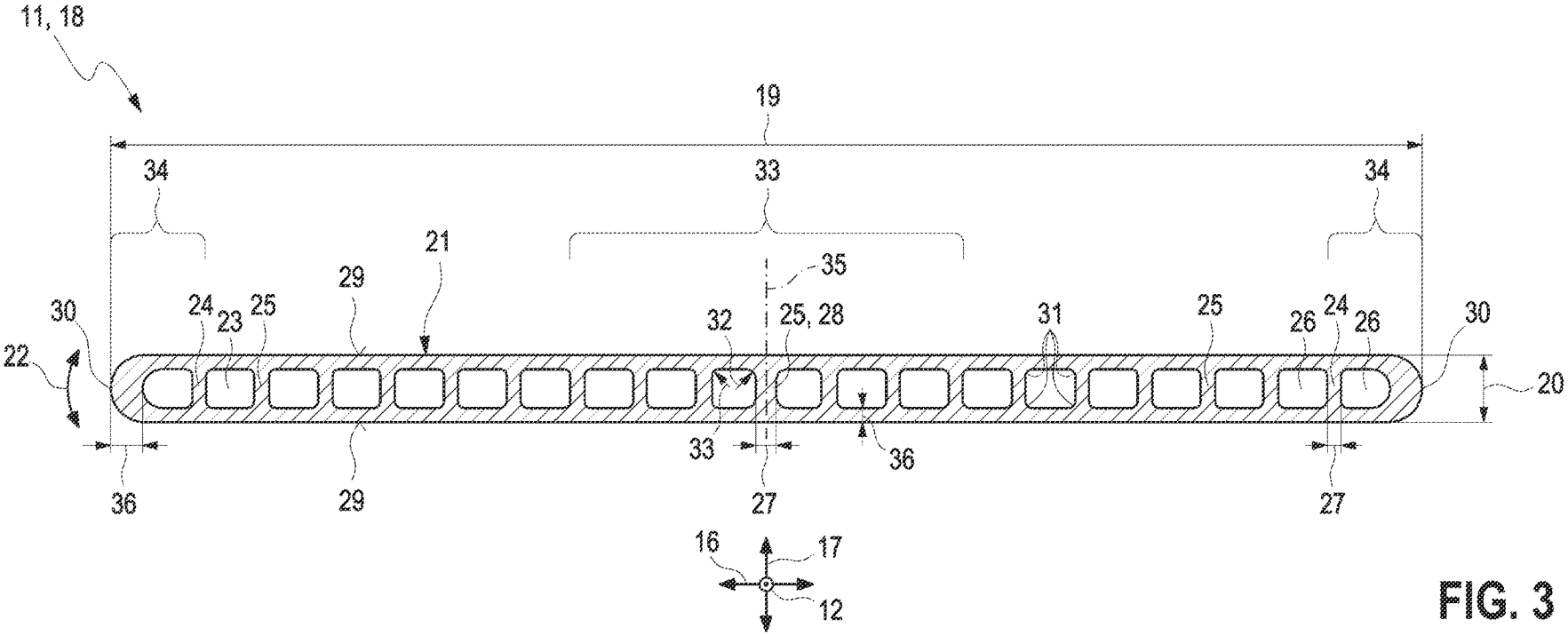
FIG. 3 shows a cross section through one of the tube bodies.

A heat exchanger 1, as it is shown for example in FIGS. 1 to 3, is usually part of a circuit 2 which is shown greatly simplified and in the manner of a circuit diagram in FIG. 1. In the circuit 2, a temperature control medium, for example a coolant or a refrigerant circulates during the operation, which flows via an inlet 3 into the heat exchanger 1 and flows via an outlet 4 out of the heat exchanger 1. The heat exchanger 1, furthermore, is fluidically separated from the temperature control medium, flowed through by a fluid as indicated by a dashed arrow 5 in FIG. 1. Thus, a heat exchange between the temperature control medium and the fluid takes place during the operation. The heat exchanger 1 can be an evaporator 6 for evaporating the temperature control medium or a condenser 7 for condensing the temperature control medium. Likewise, both an evaporator 6 and also a condenser 7 can be incorporated in the circuit 2. Furthermore, the circuit 2 can comprise a conveying device which is not shown, for example a pump, for conveying the temperature control medium through the circuit 2 and an expander which is not shown for expanding the temperature control medium. The circuit 2 is in particular part of an air conditioning system 8, which is employed in a motor vehicle 9 or in a building 10.

FIG. 2 shows a greatly simplified representation of the heat exchanger 1. The heat exchanger 1 comprises at least one tube body 11, which during the operation is flowed through by the temperature control medium, wherein the heat exchanger 1 shown in FIG. 2 purely exemplarily comprises four such tube bodies 11. The tube bodies 11 extend in a longitudinal direction 12 and can be flowed through in the longitudinal direction 12 by the temperature control medium. Located opposite in the longitudinal direction 12, two chambers 13 are provided, between which the tube bodies 11 are arranged and each received with a longitudinal end portion. The tube bodies 11 are connected with their longitudinal end portions to the respective chamber 13 in a firmly bonded manner, in particular soldered. An introduction of the temperature control medium into the tube bodies 11 and a discharging of the temperature control medium out of the tube bodies 11 is effected with the chambers 13. In the shown example, one of the chambers 13 is connected with an inlet 3 to the circuit 2 and formed as a distributor 14 for distributing the temperature control medium into the tube bodies 11. The other chamber 13 is connected with the outlet 4 to the circuit 2 and formed as a collector 15 for collecting the temperature control medium from the tube bodies 11.

FIG. 3 shows a cross section through one of the tube bodies 11, i.e., a section through a plane which is defined by a width direction 16 running transversely to the longitudinal direction 12 and a height direction 17 running transversely to the longitudinal direction 12 and transversely to the width direction 16. The tube body 11 in the shown example is formed as a flat tube 18 which has a width 19 running in width direction 16, which is at least twice as great as a height 20 of the tube body 11 running in the height direction 17. The tube body 11 has an outer cover 21. The outer cover 21 extends closed in the longitudinal direction 12 and in a circumferential direction 22 and thus limits an interior volume 23 which can be flowed through in the longitudinal direction 12. Furthermore, the tube body 11 has two outer intermediate walls 24 located opposite in the width direction 16 and inner intermediate walls 25 arranged in the width direction 16 between the outer intermediate walls 24. In the width direction 16, the intermediate walls 24 are substantially spaced apart equidistantly relative to one another. Furthermore, the outer intermediate walls 24 are spaced apart in the width direction 16 relative to the outer cover 21. Thus, the intermediate walls 24, 25 limit passages 26 of the tube body 11 within the outer cover 21 which are separated from one another in the width direction 16 and which can be flowed through in the longitudinal direction 12. A wall thickness 27 of at least one of the at least one intermediate walls 25 running in the width direction 16 is greater than the wall thickness 27 of the respective outer intermediate wall 24.

In the shown example, both outer intermediate walls 24 have the same wall thickness 27. In the shown example, the tube body 11, furthermore, has an uneven number of inner intermediate walls 25, wherein the shown tube body 11 purely exemplarily has seventeen such inner intermediate walls 25. Thus, an intermediate wall 25 that is central and arranged in the middle exists in the width direction 16, which in the following is also referred to as central intermediate wall 28. The central intermediate wall 28 is such an inner intermediate wall 25 that has a greater wall thickness 27 than the wall thickness 27 of the respective outer intermediate wall 24. Here, the wall thickness 27 of the respective inner intermediate wall 25 is maximally a third greater than the wall thickness 27 of the respective outer intermediate wall 24. In particular, the wall thickness 27 of the central intermediate wall 28 is between 1.2 times and 1.3 times, in particular 1.26 times the wall thickness of the respective outer intermediate wall 24. To better explain the size relationship, it is assumed in the following that the tube body 11 has a width 19 of 25.4 cm and a height of 1.3 cm. The wall thickness 27 of the respective outer intermediate wall 24 amounts to 0.27 cm for example. The central intermediate wall 28 for example has a wall thickness 27 of 0.34 mm.

As is evident from FIG. 3, the tube body 11 of the shown example has an oval cross section. The outer cover 21 has even flat sides 29 located opposite in the height direction 17 and curved outsides 30 located opposite in the width direction 16. The outsides 30 follow a curved course towards the inside so that they limit with the respective next-adjacent inner intermediate wall 24 a passage 26 with a cross section that is curved on the outside in the width direction 16.

The remaining passages 26 in the shown example have a basic shape that is square in the cross section with curved corners 31. From FIG. 3, it is evident that the two passages 26 limited by the central intermediate wall 28 have corners 31 on their sides facing the central intermediate wall 28 each with a curvature radius 32 that is greater than a curvature radius 33 of the corners 31 of these passages 26 that are distant from the central intermediate wall 28.

In the exemplary embodiment shown in FIG. 3, it is not only the central intermediate wall 28 that has a wall thickness 27 that is greater than the wall thickness 27 of the outer intermediate walls 24, but also the intermediate walls 25 adjoining the central intermediate wall 28 in the width direction 16. The tube body 11 can be subdivided in the width direction 16 into a centrally arranged inner portion 33 and two outer portions 34, wherein the respective outer portion 34 comprises an outer intermediate wall 24 and extends from the associated outer intermediate wall 24 as far as to the next-adjacent outside 30 of the outer cover 21. The inner portion 33 is arranged in the middle between the outer portions 34 and in the example extends over a third of the width 19 of the outer cover 21. Within the inner portion 33, all inner intermediate walls 25 have a wall thickness 27 that is greater than the wall thickness 27 of the respective outer intermediate wall 24. In the shown example, the wall thickness 27 of the inner intermediate walls 27 in the inner portion 33 decreases emanating from the central intermediate wall 28 in the width direction 16 towards the outside, so that the central intermediate wall 28 is that intermediate wall 25 with the maximum wall thickness 27. The intermediate walls 24, 25 are formed symmetrically with regard to a symmetry plane 35 extending in the longitudinal direction 12 and in the height direction 17 indicated in FIG. 3, which thus runs through the central intermediate wall 28. In the region between the inner portion 33 and the outer portions 34, the inner intermediate walls 25 have the same wall thickness 27 as the respective outer intermediate wall 24. In the shown example, the inner portion 33 exemplarily has seven inner intermediate walls 25, i.e., the central intermediate wall 28 and further six inner intermediate walls 25.

As is evident from FIG. 3, furthermore, the outer cover 21 likewise has a reinforced wall thickness 36 in its outsides 30, which in the following are referred to as cover wall thickness 36 for the better distinction from the wall thickness 27 of the intermediate walls 24, 25. It is noticeable that the cover wall thickness 36 running in the width direction 16 is greater in the region of the outsides 30 than a height wall thickness 36 running in the height direction 17 in the region of the flat sides 29. Here, the cover wall thickness 36 running in the width direction 16 is greater in the region of the outsides 30 than the respective wall thickness 27 of the intermediate walls 24, 25.

The tube body 11 is extruded for example, wherein it is also conceivable to produce the tube body 11 from a flat strip material.

It is understood that the foregoing description is that of the exemplary embodiments of the disclosure and that various changes and modifications may be made thereto without departing from the spirit and scope of the disclosure as defined in the appended claims.

What is claimed is:

1. A tube body for a heat exchanger, in particular in a motor vehicle or in a building, the tube body comprising:

an outer cover, which extends in a longitudinal direction and limits an inner volume in a circumferential direction, and which can be flowed through in the longitudinal direction;

two outer intermediate walls, which are arranged located opposite in the outer cover in a width direction running transversely to the longitudinal direction, wherein the respective outer intermediate wall of the outer cover is next-adjacent in the width direction; and at least one inner intermediate wall, which is arranged in the outer cover in the width direction between the outer intermediate walls, wherein the intermediate walls are spaced apart relative to one another in the width direction and limit passages that are separated from one another within the outer cover, which can each be flowed through in the longitudinal direction, wherein a wall thickness of at least one of the at least one inner intermediate walls running in the width direction is greater than the wall thickness of the two outer intermediate walls, and wherein the at least one inner intermediate wall with the greater wall thickness has the greater wall thickness merely in a longitudinal end portion of the tube body on the end side in the longitudinal direction.

2. The tube body according to claim 1, wherein the wall thickness of the inner intermediate wall arranged in the width direction centrally between the outer intermediate walls is greater than the wall thickness of the respective outer intermediate wall.

3. The tube body according to claim 1, wherein the wall thickness of at least one of the at least one inner intermediate walls is maximally a third greater than the wall thickness of the respective outer intermediate wall.

4. The tube body according to claim 1, wherein the tube body is formed as a flat tube which has a width running in the width direction that is greater than a height of the flat tube running in the height direction.

5. The tube body according to claim 1, wherein at least one of the outer intermediate walls forms with the outer cover a, in the width direction, outer one of the passages, and wherein the passage has a cross section which is curved on the outside in the width direction.

6. The tube body according to claim 1, wherein:

the tube body has two outer portions that are spaced relative to one another in the width direction, wherein the respective outer portion comprises one of the outer intermediate walls and extends in the width direction from the associated outer intermediate wall as far as to an outside of the outer cover that is next-adjacent in the width direction, the tube body comprises an inner portion arranged in the width direction between the outer portions and extending in the width direction, in which the wall thickness of the inner intermediate walls is greater than the wall thickness of the respective outer intermediate wall, and the inner portion extends between a tenth and a third of the width of the outer cover.

7. The tube body according to claim 6, wherein the inner portion is arranged in the width direction centrally between the outer portions.

8. The tube body according to claim 1, wherein at least one of the outsides of the outer cover next-adjacent to one of the outer intermediate walls in the width direction has a cover wall thickness running in the width direction that is greater than the wall thickness of the respective outer intermediate wall.

9. The tube body according to claim 1, wherein the tube body is extruded or formed from a flat material.

10. A heat exchanger, in particular in a motor vehicle or in a building, the heat exchanger comprising:

at least one tube body according to claim 1; and a chamber, in which the at least one tube body is received on the longitudinal end side.

11. The heat exchanger according to claim 10, wherein the tube body is connected to the chamber by a soldered connection.

12. A motor vehicle comprising:

a circuit, in which during the operation a temperature control medium circulates; and a heat exchanger according to claim 10, which is incorporated in the circuit.

13. A building comprising:

a circuit, in which during the operation a temperature control medium circulates; and a heat exchanger according to claim 10, which is incorporated in the circuit.

14. The tube body according to claim 1, wherein the outer intermediate walls and the inner intermediate walls are arranged symmetrically with regard to a symmetry plane which extends in a longitudinal direction through a central intermediate wall.

* * * * *